US010112226B2

(12) United States Patent
Del Fabro

(10) Patent No.: US 10,112,226 B2
(45) Date of Patent: Oct. 30, 2018

(54) DRAWING AND STRAIGHTENING APPARATUS FOR METAL WIRE, AND CORRESPONDING DRAWING AND STRAIGHTENING METHOD

(71) Applicant: M.E.P. MACCHINE ELETTRONICHE PIEGATRICI SPA, Reana del Rojale (IT)

(72) Inventor: Giorgio Del Fabro, Udine (IT)

(73) Assignee: M.E.P. MACCHINE ELETTRONICHE PIEGATRICI SPA, Reana Del Rojale (IT)

( * ) Notice: Subject to any disclaimer, the term of this patent is extended or adjusted under 35 U.S.C. 154(b) by 496 days.

(21) Appl. No.: 14/771,188

(22) PCT Filed: Feb. 26, 2014

(86) PCT No.: PCT/IB2014/059275
§ 371 (c)(1),
(2) Date: Aug. 27, 2015

(87) PCT Pub. No.: WO2014/132207
PCT Pub. Date: Sep. 4, 2014

(65) Prior Publication Data

US 2016/0016216 A1 Jan. 21, 2016

(30) Foreign Application Priority Data

Feb. 28, 2013 (IT) ..... UD2013A0029

(51) Int. Cl.
*B21C 19/00* (2006.01)
*B21F 1/02* (2006.01)
(Continued)

(52) U.S. Cl.
CPC ..... *B21C 19/00* (2013.01); *B21F 1/02* (2013.01); *B21F 23/00* (2013.01); *B21C 1/16* (2013.01); *B21D 43/02* (2013.01)

(58) Field of Classification Search
CPC ... B21C 1/16; B21C 19/00; B21F 1/02; B21F 23/00; B21D 43/02
See application file for complete search history.

(56) References Cited

U.S. PATENT DOCUMENTS 4,876,873 A * 10/1989 Del Fabro ..... B21D 3/05 72/162

FOREIGN PATENT DOCUMENTS

EP 0824982 2/1998
WO WO-2005/065862 7/2005
(Continued)

OTHER PUBLICATIONS

Search Report for PCT/IB2014/059275, dated Jul. 8, 2015.
Written Opinion for PCT/IB2014/059275, dated Jul. 8, 2015.

*Primary Examiner* — A. Dexter Tugbang
*Assistant Examiner* — John S Lowe
(74) *Attorney, Agent, or Firm* — Marshall, Gerstein & Borun LLP

(57) ABSTRACT

Apparatus for drawing and straightening at least a metal wire, comprising a drawing unit of the metal wire along a direction of advance which comprises a first motorized main roll, on part of the periphery of which first idle contrast rolls are disposed, with a smaller diameter than the first main roll. The apparatus also comprises a straightening only unit of the metal wire, independent from the drawing unit, disposed along the direction of advance and upstream of the drawing unit, the straightening only unit comprising a second idle
(Continued)

main roll, on part of the periphery of which second idle contrast rolls are disposed, with a diameter smaller than the second main roll.

8 Claims, 1 Drawing Sheet

(51) Int. Cl.

| | |
|---|---|
| ***B21F 23/00*** | (2006.01) |
| ***B21D 43/02*** | (2006.01) |
| ***B21C 1/16*** | (2006.01) |

(56) References Cited

FOREIGN PATENT DOCUMENTS

| | | |
|---|---|---|
| WO | WO-2010/040818 | 4/2010 |
| WO | WO-2010/043611 | 4/2010 |
| WO | WO-2012/099781 | 7/2012 |

* cited by examiner

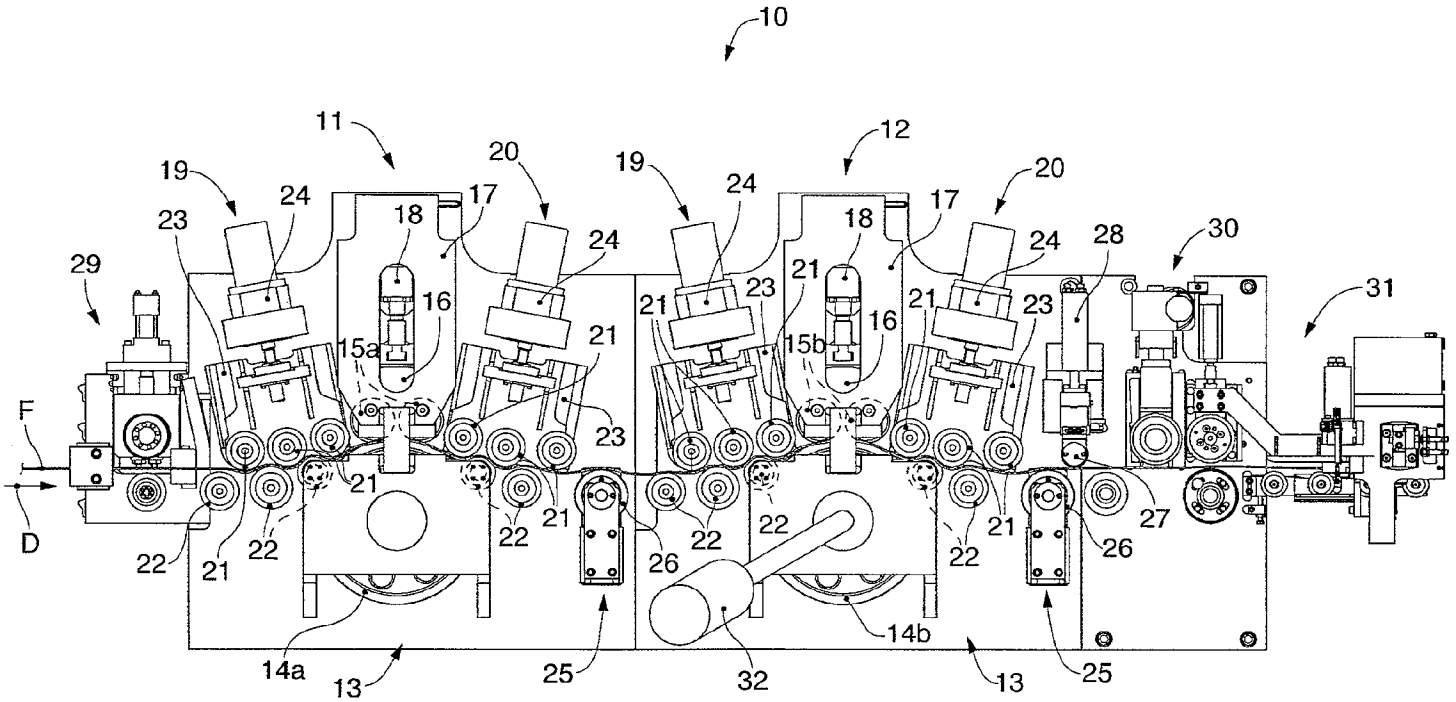
10
11
12
13
14a
14b
15a
15b
16
17
18
19
20
21
22
23
24
25
26
27
28
29
30
31
32
D
F

DRAWING AND STRAIGHTENING APPARATUS FOR METAL WIRE, AND CORRESPONDING DRAWING AND STRAIGHTENING METHOD

FIELD OF THE INVENTION

The present invention concerns a drawing and straightening apparatus for feeding machines that work oblong metal products such as bars, round pieces or metal wire, of the type usable to make reinforcements for the building trade.

In particular, the drawing and straightening apparatus according to the present invention is preferentially applied, but not only, to bending/shaping machines that can work simultaneously two metal wires at a time, performing a constantly uniform, coordinated and simultaneous feed.

The invention also concerns the connected drawing and straightening method.

BACKGROUND OF THE INVENTION

Bending/shaping or stirrup-making machines are known, hereafter shaping machines. The bending units or devices of such machines are fed with oblong metal products such as metal wire from a roll, or precut bars, to make reinforcement stirrups for the building trade. Hereafter these base materials, whether they come from a roll or are already in bars, will be referred to generically as metal wire.

It is also known that, upstream of the bending unit, shaping machines include drawing and straightening means to feed the metal wire to the operating units of the machine, such as shears and at least one bending unit.

The difficulties encountered in the drawing and straightening step of the metal wire arriving from rolling are known, which difficulties increase when the metal wire is fed to the shaping machine from a roll. In the metal wire arriving from rolling there are tensions that remain dormant until a simple bend or other is induced. This problem increases in the case of metal wire arriving from a roll, since the wire should be extracted from a reel that may or may not rotate around its own axis in order to facilitate the unwinding of the wire.

Furthermore, in the case of metal wires intended to make stirrups for reinforcements for concrete, metal alloys have appeared that confer on the metal wire physical and/or chemical properties that it did not have before, properties that accentuate the working difficulties.

These problems are more evident in the case of metal wires for reinforcement rods.

Due to the surface ribs present, such metal wires have discontinuous surfaces and a shape that is not always perfect.

It is therefore obvious that a simple bending operation made on the metal wire is conditioned by the tensions present therein, so that the possible geometric forms made with the metal wire not only do not keep the desired geometric disposition, but do not even maintain the flat spatial disposition.

In the case of reinforcement stirrups therefore, unwanted shapes are obtained with different angles and/or with the sides spatially three-dimensional.

The stirrups are therefore unusable, or are poor quality and low reliability when installed, and generally speaking should be discarded. In addition, in the case of metal wire for reinforcement rods, given the continuous variation in its section, the correct and accurate drawing and/or straightening becomes uncertain, not constant and not uniform.

It must be said here that metal wires for reinforcements have an extensive range of measurements, which can go from 5 mm to 24 mm and more in diameter, and that a shaping machine must be able to work all this range of sizes always and in any case obtaining a perfect product.

It goes without saying that the problems raised by a metal wire with a diameter of 5 mm are therefore much less than those raised by a metal wire with a diameter of 24 mm, at least in terms of size.

It must also be noted that in a shaping machine the drawing and straightening means take on another considerable importance, since they also have the function of defining the measurements required on each occasion between one bending operation and the next.

When the drawing and straightening means do not perform their function constantly and without errors, it is not possible either to make stirrups or other shapes of metal wire with the desired sizes, or to make a plurality of identical stirrups, whether in sequence or not.

It is understood that the drawing and straightening means should be configured both to feed a single metal wire, and also two or more metal wires fed in parallel and simultaneously.

Purpose of the present invention is to obtain a drawing and straightening apparatus that can operate continuously and precisely with any type of metal wire whatsoever, in particular metal wire for reinforcements. This serves to guarantee that the advance of the metal wire is constant, uniform and the correct value on each occasion, also preventing rotations of the metal wire upon itself during advance. To this purpose a total requalification of the way to approach the drawing and straightening apparatus has been made.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purpose, a drawing and straightening apparatus of at least a metal wire comprises a drawing unit provided to move the metal wire along a direction of advance, and provided with a first motorized main roll, large size, on part of the periphery of which first idle contrast rolls are disposed, with a smaller diameter than that of the first main roll. Due to the contrasting action of the first idle contrast rolls, actuating the first motorized main roll causes the metal wire to advance between them toward a shaping machine disposed downstream, for example of the type used to make reinforcement stirrups for the building trade.

According to one aspect of the present invention, the apparatus also comprises a straightening only unit of the metal wire, independent from the drawing unit, disposed along the direction of advance and upstream of the drawing unit, and also comprising a second idle main roll, large size, on part of the periphery of which second idle contrast rolls are disposed, with a diameter smaller than the second main roll.

The straightening only unit has a configuration generally the same type as the drawing unit, and exerts on the metal wire in transit a plastic deformation such as to reduce the internal tensions present in the latter.

In particular, the simultaneous presence of the drawing unit with the large size main roll and corresponding contrast rolls, and the straightening only unit located upstream, also having a large size main roll and contrast roll, assists the advance of the wire and in particular its unwinding from the reel, if present.

In fact, on the advancing wire at least two consecutive loops are made, adjustable in amplitude, caused by the presence of the contrast rolls, around part of the periphery of the large size main roll. The formation of loops at the same time guarantees high extraction forces, considerably reducing the possibility of rotation of the wire.

This solution is particularly advantageous from the production point of view, since the number of different components and the complexity of production are reduced.

According to some forms of embodiment of the invention, the drawing unit and/or the straightening only unit comprises at least a straightening member, disposed upstream or downstream of the first main roll and/or a second main roll, and also provided with respective rolls. The function of the straightening member is to increase the deformation effect induced on the metal wire and also, if it is disposed upstream of the first and/or second main roll, to guide its introduction into one of the latter.

The present invention also concerns the method to draw and straighten at least one metal wire that uses a drawing and straightening unit as described above.

BRIEF DESCRIPTION OF THE DRAWINGS

These and other characteristics of the present invention will become apparent from the following description of a preferential form of embodiment, given as a non-restrictive example with reference to the attached drawing wherein:

FIG. 1 shows a drawing and straightening apparatus according to the invention.

To facilitate comprehension, the same reference numbers have been used, where possible, to identify identical common elements in the drawings.

DETAILED DESCRIPTION OF ONE FORM OF EMBODIMENT

With reference to FIG. 1, a drawing and straightening apparatus 10 according to the present invention can be associated with a shaping machine, not shown in the drawings, for working oblong metal products such as metal wires F.

The drawing and straightening apparatus 10 is suitable to perform both drawing functions and also straightening functions simultaneously.

The drawing and straightening apparatus 10 in this case comprises two distinct operating units, respectively a first operating unit 11, or straightening unit, configured to perform only straightening and anti-rotation operations on the metal wire F, and a second operating unit 12, or drawing unit, configured to exert on the metal wire F not only a straightening and anti-rotation action but also a drawing action in a direction of advance D, which substantially coincides with the direction of advance that a metal wire F already linearized would have, in order to reach the devices disposed downstream.

The first operating unit 11 is disposed upstream, with respect to the direction of advance D of the metal wire F, of the second operating unit 12. This configuration guarantees uniformity and continuity in the advance of the metal wire F, preventing problems of blocking of the metal wire F in the first operating unit 11, and a more effective extraction of the metal wire F.

With reference to FIG. 1, is describe the configuration of the first operating unit 11 which, unless otherwise indicated, should be understood as valid also for the second operating unit 12.

The first operating unit 11 comprises a supporting frame 13 on which a main roll is mounted, rotatable around its axis of rotation disposed substantially orthogonal to the direction of advance of the metal wire F. Hereafter the main roll of the first operating unit 11 is indicated by the reference number 14*a* whereas that of the second operating unit 12 is indicated by 14*b*.

In this case, two contrast rolls 15*a* or 15*b* respectively with reference to the first operating unit 11 and the second operating unit 12 act on the periphery of the main roll 14*a* or 14*b*, and, forming a loop in the contact zone with the corresponding main roll 14*a*, 14*b* exert a straightening and anti-rotation action on the metal wire F around part of the periphery of the main roll 14*a* or 14*b*.

The main roll 14*a* or 14*b* has a bigger diameter than the diameter of the contrast rolls 15*a* or 15*b*. Merely by way of example, the main roll 14*a* or 14*b* can have a diameter comprised between 300 mm and 600 mm, while the contrast rolls 15*a* or 15*b* can have a diameter comprised between 100 mm and 200 mm.

The contrast rolls 15*a* or 15*b* are mounted on a slider 16 translatable in a direction orthogonal to the direction of advance D of the metal wire F in order to vary the pressure and hence the anti-rotation action which the contrast rolls 15*a* or 15*b* exert on the metal wire F and consequently on the main roll 14*a* or 14*b*, also in relation to the diameter of the metal wire F and/or the requirements of uniform advance.

The slider 16 is in turn mounted on a fixed support structure 17, solid with the supporting frame 13.

An actuator 18 is associated with the support structure 17 and slider 16, and is suitable to move the slider 16 toward the main roll 14*a* or 14*b*.

The actuator 18 can comprise hydraulic, pneumatic, electric actuators, worm screw mechanisms, racks or suchlike.

Upstream and downstream of the main roll 14*a* or 14*b* a first straightening member 19 is provided, and respectively a second straightening member 20.

The first straightening member 19 and second straightening member 20 are provided with respective rolls 21 that cooperate during use with contrast rolls 22 associated with the supporting frame 13.

Some forms of embodiment provide that the supporting frame 13 of the first operating unit 11 and the second operating unit 12 are independent from each other and able to be selectively put adjacent and coupled with each other by means of suitable reciprocal connection means.

In the form of embodiment in FIG. 1, the first straightening member 19 and second straightening member 20 are mounted on respective frames 23 which can be moved, by means of respective actuators 24, toward the contrast rolls 22 to regulate the pressure that the rolls 21 exert on the metal wire F, also in relation to the diameter of the latter and/or the requirements of uniform advance.

The actuators 24 can comprise hydraulic, pneumatic, electric actuators, worm screw mechanisms, racks or suchlike.

The rolls 21 and the contrast rolls 22 are mounted idle respectively on the frames 23 and the supporting frame 13, and rotate around axes of rotation substantially orthogonal to the direction of advance of the metal wire F.

The metal wire F is deformed in order to straighten it by passing through a path with curved segments, both in the first operating unit 11 and the second operating unit 12, which is defined by the cooperation between the first straightening member 19 and the contrast rolls 22, between the main roll 14*a* or 14*b* and the contrast rolls 15*a* or 15*b*, and between the second straightening member 20 and the contrast rolls 22. The metal wire F is subjected to straightening on a plane substantially orthogonal to the axis of rotation of the rolls 14*a* or 14*b*, 15*a* or 15*b*, 21, 22.

Downstream of the second straightening member 20 a finishing member 25 is provided, which exerts a straightening action on the metal wire F on a plane substantially orthogonal to the straightening plane of the other rolls.

The finishing member 25 is provided with a finishing roll 26 lying on a plane substantially parallel to the lying plane of the main roll 14*a* or 14*b*, and is selectively translatable by suitable movement means in a direction parallel to its axis of rotation.

Some forms of embodiment may provide that the apparatus 10 comprises a pressing roll 27, cooperating during use with the finishing roll 26 of at least one of either the first operating unit 11 or the second operating unit 12, in this case the pressing roll 27 of the second operating unit 12.

The pressing roll 27 is selectively movable in a direction orthogonal to the direction of advance D by a respective actuator 28, in order to keep the metal wire F, plastically deformed by the finisher roll 26, inside the groove or grooves of the latter, and to exert an adequate straightening action.

Upstream of the first operating unit 11 an introduction unit 29 is provided, which allows the correct introduction and guide of the metal wire F toward the units disposed downstream.

Downstream of the second operating unit 12 another finishing member 30 is provided, substantially analogous to the finishing member 25 but acting on the metal wire F on the opposite side with respect thereto.

Downstream of the other finishing member another introduction unit 31 is provided toward the operating units located downstream, such as for example a counter roll, a shears, or guide rolls for the metal wire F.

According to the present invention the main roll 14*a* or 14*b* of one of either the first operating unit 11 or the second operating unit 12, in this case of the second operating unit 12, is motorized.

To this purpose, a motor 32 is associated to the main roll 14*b* of the second operating unit 12, and determines a drawing action on the metal wire F stored for example in a wire collection device disposed upstream.

The wire collection device comprises in general a spool on which the metal wire F is wound in coils. The spool can be associated with auxiliary devices that unwind the metal wire F when the drawing and straightening apparatus 10 is driven. In other forms of embodiment, the spool is mounted fixed and the drawing and straightening apparatus 10 provides to extract from the spool the quantity of metal wire F required on each occasion.

Even if the drawing and straightening apparatus 10 has been described with reference to advancing a single metal wires F at a time, it is not excluded that in other forms of embodiment it may be suitable to advance two or more metal wires F.

In this case the main roll 14*a* or 14*b*, the contrast roll 15*a* or 15*b*, the rolls 21, the contrast rolls 22, the finishing roll 26 and the pressing roll 27 are each provided with respective guide grooves disposed substantially aligned and each suitable to guide one of the metal wires F.

Some forms of embodiment may provide that the rolls are made in a single body and provided with the guide grooves.

If the rolls are made in a single body, it may be provided that at least some of them are associated to a unit pivoting on the plane containing the axis of rotation and orthogonally to the axis of the metal wire F, so that they are always able to press with the desired value on the metal wire F in transit.

In other forms of embodiment it is provided that the rolls are divided and that each part into which they are divided is provided with a respective guide groove.

It is clear that modifications and/or additions of parts may be made to the drawing and straightening apparatus 10 as described heretofore, without departing from the field and scope of the present invention.

It is also clear that, although the present invention has been described with reference to some specific examples, a person of skill in the art shall certainly be able to achieve many other equivalent forms of drawing and straightening apparatus, having the characteristics as set forth in the claims and hence all coming within the field of protection defined thereby.

The invention claimed is:

1. Apparatus for drawing and straightening at least a metal wire, comprising a drawing unit for drawing said metal wire along a direction of advance which comprises a first motorized main roll having a periphery and including first idle contrast rolls disposed on part of the periphery of the first main roll, with the first idle contrast rolls having a smaller diameter than a diameter of said first main roll, and including a straightening only unit for straightening said metal wire, independent from said drawing unit, disposed along said direction of advance and upstream of said drawing unit, said straightening only unit comprising a second idle main roll having a periphery and including second idle contrast rolls disposed on part of the periphery of the second idle main roll, with the second idle contrast rolls having a diameter smaller than a diameter of said second idle main roll.

2. Apparatus as in claim 1, wherein at least one of said drawing unit or said straightening only unit comprises a straightening member, disposed along the direction of advance and provided with respective rolls.

3. Apparatus as in claim 2, wherein at least one of said straightening only unit or said drawing unit further comprises a second straightening member disposed along the direction of advance.

4. Apparatus for drawing and straightening at least a metal wire, comprising a drawing unit for drawing said metal wire along a direction of advance which comprises a first motorized main roll having a periphery and including first idle contrast rolls disposed on part of the periphery of the first main roll, with the first idle contrast rolls having a smaller diameter than a diameter of said first main roll, and including a straightening only unit for straightening said metal wire, independent from said drawing unit, disposed along said direction of advance and upstream of said drawing unit, said straightening only unit comprising a second idle main roll having a periphery and including second idle contrast rolls disposed on part of the periphery of the second main roll, with the second idle contrast rolls having a diameter smaller than a diameter of said second idle main roll, and wherein at least one of said straightening only unit or said drawing unit comprises a finishing roll having an axis of rotation and lying on a plane substantially parallel to a lying plane of said first main roll or second idle main roll and selectively translatable in a direction parallel to the axis of rotation.

5. Apparatus as in claim 4, and further including a pressing roll cooperating, during use, with said finishing roll and selectively movable in a direction orthogonal to the direction of advance.

6. Apparatus as in claim 1, wherein said straightening only unit and said drawing unit comprise a respective supporting frame.

7. Method for drawing and straightening at least a metal wire and comprising: the drawing of said metal wire in a direction of advance with a drawing unit provided with a first motorized main roll having a diameter and a periphery, and disposing first idle contrast rolls having a diameter smaller than the diameter of the first motorized main roll on part of the periphery of the first main roll, and including a straightening step using a straightening only unit of said metal wire, independent from said drawing unit, disposed in said direction of advance upstream from said drawing unit, and further comprising a second idle main roll having a diameter and a periphery and disposing second idle contrast rolls on part of the periphery of the second idle main roll, the second idle contrast rolls having diameters smaller than the diameter of said second idle main roll.

8. Method as in claim 7, wherein said metal wire passes first through said straightening only unit and then through said drawing unit.

* * * * *